United States Patent [19]

Kagawa et al.

[11] Patent Number: 4,904,216

[45] Date of Patent: Feb. 27, 1990

[54] PROCESS FOR PRODUCING THE CENTER ELECTRODE OF SPARK PLUG

[75] Inventors: Junichi Kagawa; Toru Hayashi, both of Aichi, Japan

[73] Assignee: NGK Spark Plug Co., Ltd., Aichi, Japan

[21] Appl. No.: 649,775

[22] Filed: Sep. 12, 1984

[30] Foreign Application Priority Data

Sep. 13, 1983 [JP] Japan ..... 58-167573
Jun. 27, 1984 [JP] Japan ..... 59-132740

[51] Int. Cl.[4] ..... H01T 21/02
[52] U.S. Cl. ..... 445/7
[58] Field of Search ..... 445/7, 49

[56] References Cited

U.S. PATENT DOCUMENTS

| | | | |
|---|---|---|---|
| 2,439,590 | 4/1948 | Tognola | 445/7 |
| 2,615,441 | 10/1952 | Bychinsky | 445/7 |
| 3,144,576 | 8/1964 | Hagmaier | 445/7 |
| 3,407,326 | 10/1968 | Romine | 445/7 |
| 3,967,149 | 6/1976 | Eaton | 445/7 |

FOREIGN PATENT DOCUMENTS

| | | | |
|---|---|---|---|
| 2224270 | 11/1973 | Fed. Rep. of Germany | 445/7 |
| 0020614 | 6/1971 | Japan | 445/7 |
| 0680374 | 10/1952 | United Kingdom | 445/7 |

*Primary Examiner*—Kurt Rowan
*Attorney, Agent, or Firm*—Sughrue, Mion, Zinn, Macpeak & Seas

[57] ABSTRACT

A process for producing a center electrode for a spark plug comprises the following steps: providing a cylindrical electrode body of a less noble metal which is predominantly made of a nickel alloy or a composite thereof with a copper core, the electrode body having a concentric, smaller-diameter projection from the tip of the body; placing on the tip of the electrode body a disk which has a center hole into which the projection fits and which is made of a noble metal such as platinum or an alloy thereof; electrically welding the noble metal disk to the tip of the electrode body; and drawing and extruding the assembly to reduce its outside diameter so that the layer of the noble metal or alloy thereof covers at least the side wall of the part close to the tip of the electrode body.

4 Claims, 3 Drawing Sheets

PROCESS FOR PRODUCING THE CENTER ELECTRODE OF SPARK PLUG

BACKGROUND OF THE INVENTION

1. Field of the Invention

The present invention relates to a process for producing the center electrode of a spark plug in an internal combustion engine which has a layer of noble metal provided on the tip of the electrode, particularly in the periphery of its cylindrical tip.

2. Prior Art

The electrodes of a spark plug for use in an internal combustion engine desirably have a small diameter which is effective for reducing the discharge voltage and improving the ignition performance due to unhindered flame development. However, a thin electrode is easily heated up and dissipates less heat, and if, as in the usual case, it is made of a less noble metal such as a common nickel alloy, the electrode wears rapidly at elevated temperatures. In order to avoid this problem, several methods have been proposed for providing the tip of the center electrode with a noble metal layer having improved resistance to corrosion and spark wear. In one method, a noble metal is bonded to the tip of a center electrode and the assembly is extruded through a die to form a layer of the noble metal that covers the entire part of the electrode tip (see Japanese Patent Publication No. 22989/1974). According to another method, a pipe or ring of a noble metal is bonded to the tip of a center electrode (see Japanese Patent Public Disclosure No. 163976/1982). The third method proposes the use of a wire consisting of a noble metal cladding and a less noble metal core, said wire being cut to a given length suitable for bonding to the tip of a center electrode. However, these methods are expensive and require the use of costly noble metals not only in the area that must be protected from corrosion and wear but also in other areas that need no such protection.

SUMMARY OF THE INVENTION

The present invention has been accomplished to eliminate these defects of the conventional methods for producing the center electrode of a spark plug. According to its one aspect, the process of the present invention comprises providing a cylindrical electrode body which is made of a less noble metal and has on its tip a concentric projection which is smaller in diameter than said electrode body, placing on the tip of said electrode body a disk of a noble metal having in its center a hole that fits said projection, electrically welding said noble metal disk onto the tip of said electrode body, and drawing and extruding the assembly to reduce its diameter so that a layer of said noble metal is provided on at least the side wall of the tip of said electrode body.

According to its another aspect, the process of the present invention comprises providing a cylindrical electrode body which is made of a less noble metal as in the first aspect but has a concentric, bottomed recess on its tip, fitting into said recess a disk or annular ring of a noble metal such as platinum or its alloy, welding said disk or ring to the electrode body, annealing the assembly, and drawing and extruding the assembly to reduce its diameter so that a layer of said noble metal covers at least the side wall of the tip of said center electrode.

According to either aspect of the present invention, center electrodes adapted to various types of spark plugs can be produced by providing a layer of noble metal on at least the periphery or side wall of the tip portion. As a further advantage, the noble metal layer is accurately provided in the spark discharge portion of the center electrode. In the second aspect of the invention, the peripheral portion of the noble metal layer remains securely fitted against the inner wall of the recess in the tip of the electrode body as the assembly of the two members is being drawn through a die. Therefore, the center electrode produced by the method of the present invention is highly durable and permits a great reduction in the amount of the noble metal used.

BRIEF DESCRIPTION OF THE DRAWINGS

FIGS. 1 to 4 show the individual steps for producing the center electrode of a spark plug according to the first aspect of the present invention, wherein FIG. 1 is a partial longitudinal section of the work before welding;

FIG. 2 is a partial longitudinal section of an electrode body to which a noble metal layer has been welded;

FIG. 3 is a partial longitudinal section of the work being drawn through a die; and FIG. 4 is a partial longitudinal section of a completed center electrode which is installed as a member of the spark plug.

PREFERRED EMBODIMENTS OF THE INVENTION

Figure 1:
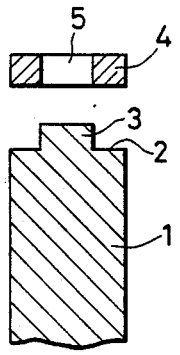
Figure 2:
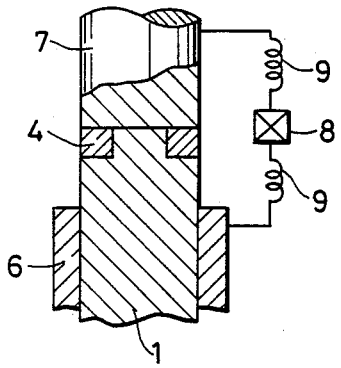

The process for producing a center electrode according to the present invention and the manner in which the electrode so prepared is used as a member of a spark plug are hereunder described in detail.

FIGS. 1 to 4 show the individual steps for producing the center electrode according to the first aspect of the present invention. In each Figure, 1 represents an electrode body made of a less noble metal selected from among nickel and iron alloys including Ni-Si-Cr-Al-Mn alloy (Si 0.2–3%, Cr 0.2–3%, Al 0.2–3%, Mn<0.5%, and the balance being Ni), Inconel (Ni 70%, Cr 14–16%, Fe 5–9%, A 0.4–1% and Si 0.5%), Hastelly (Ni 55–59%, Mo 12–18%, C 0.04–0.15% and Fe 18–22%), and Fe-base stainless steel. This electrode body is cylindrical and has a copper core in its inside. The end portion 2 of this electrode body 1 has a concentric projection 3 which is smaller in diameter than the electrode body. The reference numeral 4 represents a disk of a noble metal (for the purposes of the present invention, a thin cylindrical shape is also included) such as Pt, Pt-Ir, Pt-W, Pt-Rh, Pt-Pd, Pt-Ni, Au-Pd, Au-Pd-Cr or Au-Pd-Ag. These metals are typically in the form of a thin rolled sheet of a thickness 0.1–0.5 mm. The disk 4 has a hole 5 that fits the projection 3 on the electrode body 1.

According to the process of the present invention, the electrode body 1 is first mounted in an electric welder by being fixed in a chuck electrode 6 as shown in FIG.

2, with the tip portion of said electrode body extending beyond the chuck electrode. The disk 4 of a noble metal is positioned on the tip of the electrode body in such a manner that the hole 5 is in alignment with the projection 3. A plunger electrode 7 is lowered to apply pressure to the electrode body and at the same time, a large electric current is supplied momentarily between the chuck electrode 6 and plunger electrode 7 from a welding transformer comprising a power source 8 and electric wires 9. By these procedures, the noble metal disk 4 is welded to the electrode body 1.

Figure 3:
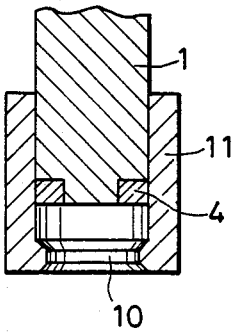

Then, as shown in FIG. 3, the electrode body 1 is inserted into a die 11 at the end portion having the noble metal disk 4 and is drawn through a hole 10 having a smaller diameter than the electrode body. As a result of this drawing operation, the diameter of the electrode body 1 is reduced and the noble metal disk 4 is stretched to cover the side wall of its tip portion. This completes the production of a center electrode (see FIG. 4). If desired, the electrode body 1 to which the noble metal disk 4 has been welded may be subsequently annealed (1000° C.×2 hr) to form a diffused layer in the weld joint.

Figure 4:
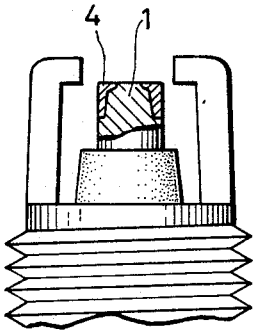

The foregoing description concerns the making a center electrode for use in a multi-electrode spark plug. Since this type of center electrode produces a spark by discharging at the tip and the periphery of the nearby portion, the noble metal layer 4 must be provided in the corresponding area. In order to meet this requirement, an electrode body of a small diameter is equipped with a noble metal disk of an equally small outside diameter, and the combination of these two members is drawn through a die at a relatively small draw-down ratio. By this method, a center electrode having a noble metal layer formed not only at the tip but also in the side wall of the nearby portion as illustrated in FIG. 4 can be produced.

Figure 5:
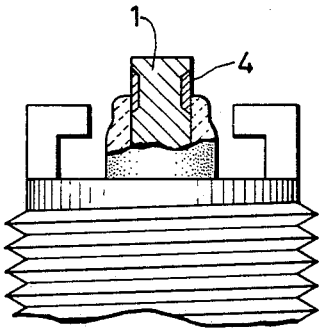
FIGS. 5 to 7 are partial longitudinal sections of spark plugs of types other than the one shown in FIG. 4.

In the case of a spark plug having a "back side electrode", the center electrode wears more rapidly in the side wall near the end portion of the insulator than the tip of the electrode. Therefore, an electrode body of a large diameter is equipped with a noble metal disk having an equally large outside diameter and a large inside diameter 5, and the combination of the two members is drawn through a die at a relatively high draw-down ratio. By so doing, a center electrode having a noble metal layer formed only in the side wall of a portion near to the tip of the electrode as shown in FIG. 5 can be obtained.

Figure 6:
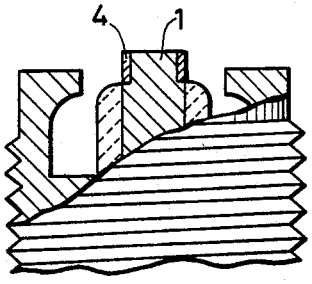
Figure 7:
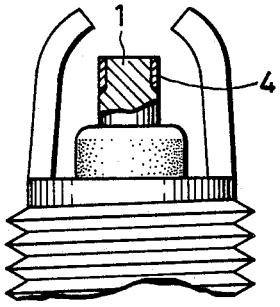
Figure 8:
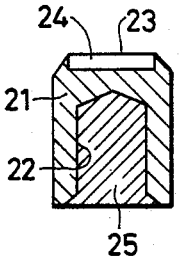
FIGS. 8 to 11 show the individual steps for producing the center electrode of a spark plug according to the second aspect of the present invention.

There are other types of spark plugs such as the one having a ribbed casing as shown in FIG. 6, as well as the type BP5EJ having an inclined grounded electrode opposing the annular end portion of the center electrode as shown in FIG. 7. The center electrodes for use in these types of spark plugs may be fabricated by properly selecting the outside diameter of the noble metal disk, the diameter of the hole in the disk and the drawdown ratio through the die.

Figure 9:
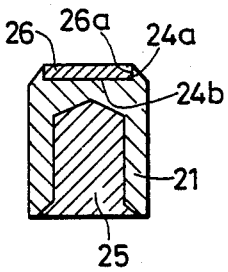
Figure 10:
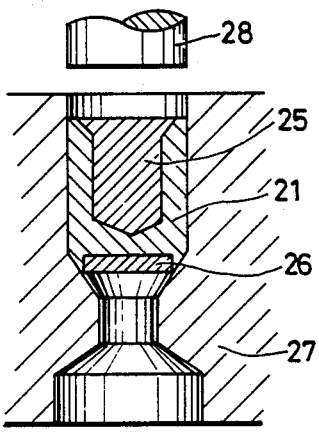
Figure 11:
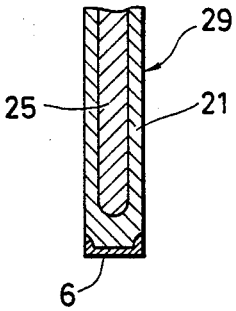

The steps for manufacturing the center electrode for use in a spark plug according to another embodiment of the present invention are shown in FIGS. 8 to 11. The electrode body used in this particular embodiment is generally indicated at 21 and has a cup-shaped hole 22 into which is fitted a copper core 25. The end portion 23 of the electrode body has a bottomed recess 24. A noble metal disk 26 is fitted into the recess 24 and bonded thereto by welding (FIG. 9). The disk is in the form of a thin rolled sheet (0.1–0.5 mm) made from Pt, Pt-Ir, Pt-W, Pt-Rh, Pt-Pd, Pt-Ni, Au-Pd, Au-Pd-Cr or Au-Pd-Ag. After annealing at ca. 1,000° C. for 2 hr, the electrode body 21 is inserted into the cavity of a die 27 as shown in FIG. 10 and extruded through the die by a plunger pin 28 to attain the predetermined outside diameter of the center electrode. The resulting center electrode 29 has the noble metal layer formed not only at the tip of the electrode body 21 but also in the periphery of the nearby portion (FIG. 11). The bottomed recess 24 may be formed after the copper core 25 is fitted into the cup-shaped hole 22 in the electrode body 21.

Figure 12:
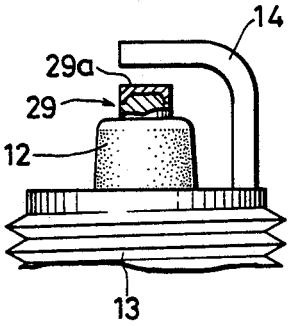
FIGS. 12 and 13 are sections showing the essential parts of spark plugs using the center electrode produced by the steps shown in FIGS. 8 to 11.
Figure 13:
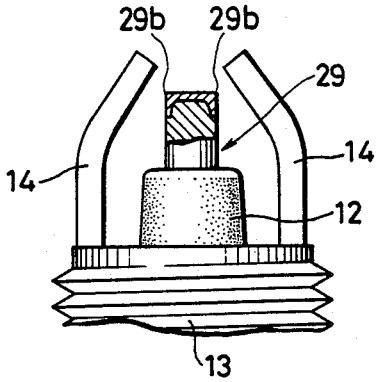

The center electrode 29 fabricated by the above procedure is suitable for use in a spark plug of the type shown in FIG. 12 wherein the electrode projects from its insulating holder 12, and its end portion **29*a* faces a parallel outer electrode 14 protruding from a metal casing 13. The center electrode 29 is also adapted to use in a spark plug of the type shown in FIG. 13 wherein the edge 29*b* of the tip of the electrode faces an inwardly inclined outer electrode 14. Either arrangement is effective for avoiding the excessive wear by spark of the discharging surface of the center electrode. Needless to say, a noble metal layer (e.g. Pt) may be bonded to the discharging surface of the outer electrode 14**.

Figure 14:
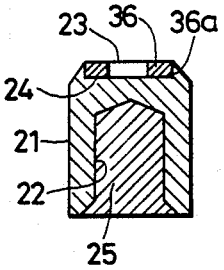
FIGS. 14 to 16 show how a center electrode can be produced according to the third aspect of the present invention.
Figure 15:
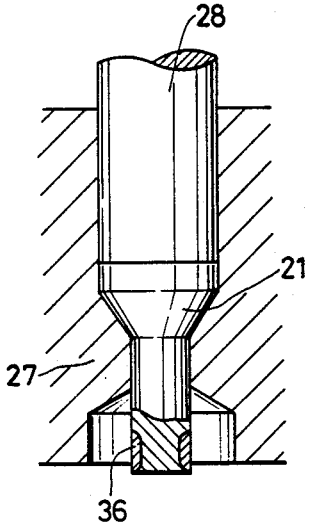
Figure 16:
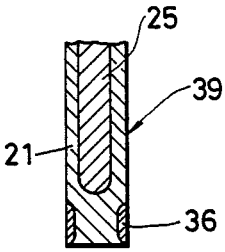

Still another embodiment of the process for producing a center electrode according to the present invention is shown in FIGS. 14 to 16. An electrode body 21 has a cupshaped hole 22 filled with a copper core 25. The body also has a bottomed recess 24 in the surface of its end portion 23. An annular metal member 36 is electrically welded to the walls of the recess 24 and subsequently annealed as in the second embodiment. The so treated assembly is drawn and extruded thorugh a die 27 as shown in FIG. 15. The resulting center electrode 39 can also be used with a spark plug of the type shown in FIGS. 5 and 6.

In the embodiments shown above, the electrode body 1 or 21 is drawn from the side fitted with a noble metal layer, but it should be understood that the electrode may be fed into the die from the other side.

As will be apparent from the foregoing description, the process of the present invention is simple and by proper selection of the shape of the noble metal disk and the drawdown ratio, the process permits the speedy production of center electrodes of good quality adapted to various types of spark plugs. As a further advantage, the process achieves a significant reduction in the materials cost of the center electrode by ensuring the provision of an expensive noble metal only in that part of the electrode body where spark discharge occurs.

What is claimed is:

1. A process for producing a center electrode for a spark plug comprising the following steps:

providing a cylindrical electrode body of a less noble metal which is predominantly made of a nickel alloy or a composite thereof with a copper core, said electrode body having a larger diameter portion and a concentric, smaller-diameter projection from the tip of the larger diameter portion of said body;

placing on the tip of said electrode body a disk which has a center hole into which said projection fits and which is made of a noble metal such as platinum or an alloy thereof;

electrically welding said noble metal disk to the tip of said electrode body; and drawing and extruding the assembly to reduce its outside diameter to a diameter less than the original diameter of said larger diameter portion so that the layer of said noble metal or alloy thereof covers at least the side wall of the part close to the tip of said electrode body while leaving exposed a center portion of the end face of said electrode body.

2. A process according to claim 1 wherein said noble metal or alloy thereof is Pt, or Pt-Ir, Pt-W, Pt-R, Pt-Pd, Pt-Ni, Au-Pd, Au-Pd-Cr or Au-Pd-Ag.

3. A process for producing a center electrode for a spark plug comprising the following steps:

providing a cylindrical electrode body of a less noble metal which is predominantly made of a nickel alloy or a composite thereof with a copper core, said electrode body having a concentric, bottomed recess in the tip of the body, said recess having a diameter less than the diameter of said electrode body;

fitting into said recess a disk or an annular disk of a noble metal such as platinum or an alloy thereof, said disk or annular disk having a diameter less than the diameter of said electrode body at the time said disk is fitted into said recess;

welding said disk to the walls of said recess;

annealing the resulting assembly; and drawing and extruding the assembly to reduce its outside diameter to a diameter less than the original diameter of the cylindrical electrode body so that the layer of said noble metal or alloy thereof covers at least the side wall of the part close to the tip of said electrode.

4. A process according to claim 3 wherein said noble metal or alloy thereof is Pt, or Pt-W, Pt-Rh, Pt-Pd, Pt-Ni, Au-Pd, Au-Pd-Cr or Au-Pd-Ag.

* * * * *